United States Patent [19]

Bennett

[11] Patent Number: 4,829,932

[45] Date of Patent: May 16, 1989

[54] TOE AND BALL LASTER AND THE LIKE

[75] Inventor: George Bennett, Milford, N.H.

[73] Assignee: International Shoe Machine Corporation, Nashua, N.H.

[21] Appl. No.: 231,635

[22] Filed: Aug. 10, 1988

Related U.S. Application Data

[63] Continuation of Ser. No. 944,085, Dec. 22, 1986, abandoned.

[51] Int. Cl.[4] ..... B05C 3/20

[52] U.S. Cl. ..... 118/411; 118/412

[58] Field of Search ..... 118/411, 412, 315

[56] References Cited

U.S. PATENT DOCUMENTS 3,849,818 11/1974 Brailsford et al. ..... 118/315 X

FOREIGN PATENT DOCUMENTS 3341118 8/1984 Fed. Rep. of Germany .

1297122 11/1972 United Kingdom ..... 118/411

*Primary Examiner*—Shrive Beck

*Assistant Examiner*—Alain Bashore

*Attorney, Agent, or Firm*—Robert Shaw

[57] ABSTRACT

A machine to apply adhesive to the toe and ball region of a footwear upper assembly that includes a last, an upper draped about the last and an insole at the last bottom. The machine includes a pair of adhesive nozzles to apply the adhesive onto the footwear upper assembly near the edge of the insole, a pair of nozzle arms, one nozzle arm of the pair of nozzle arms being secured to each nozzle of the pair of adhesive nozzles and adapted to move the nozzle secured thereto; and a mechanical structure operable to guide the nozzles along respective paths adjacent each edge of the insole to deposit a ribbon of adhesive onto the upper assembly from the toe of the upper assembly to the ball region of the upper assembly. The mechanical structure includes a nozzle-guide template that is configured to an outline that, together with other mechanical structures, matches the outline of the insole between the toe and the ball region of the smallest upper assembly of the style to be lasted. The nozzle-guide template has a guide surface and is shiftable to accommodate, for example, right footwear upper assemblies and left footwear upper assemblies of the style to be lasted: The nozzle-guide template is composed of a plurality of segments at the toe region thereof to permit angular adjustment of one segment relative to the other to match the shape of the insole for footwear sizes larger than the smallest footwear upper assembly. A template follower is connected to each nozzle arm, one follower being positioned to ride along the guide surface of each nozzle-guide segment. A drive mechanism is provided to move the template follower from the toe region of its associated nozzle-guide template to the ball region thereof.

19 Claims, 4 Drawing Sheets

TOE AND BALL LASTER AND THE LIKE

This application is a continuation of application Ser. No. 944,085, filed Dec. 22, 1986, now abandoned.

The present invention relates to machines particularly well adapted to last the toe and ball region of a footwear upper assembly.

While the present invention has applicability to footwear more generally, it is explained mostly in the context of shoe upper assemblies Furthermore, while the machine disclosed herein is discussed in greatest detail with respect to lasting of the toe and ball region of a footwear upper assembly, its use is broader in scope.

Presently used toe and ball lasters are disclosed in U.S. Pat. No. 4,517,697 (Vornberger). Other schemes have been presented for lasting the toe and ball region of a shoe upper assembly using microprocessor technology. The present invention, however, employs air cylinders, single-speed stepper electric motors and associated mechanical structures to guide adhesive extruding, single output nozzles while those nozzles move along and apply adhesive in and about the periphery of the insole of a shoe upper assembly. The upper assembly includes a last, an insole disposed at the last bottom and an upper draped about the last. Typically the last is disposed bottom down and the adhesive is distributed as two ribbons beginning at the toe of the shoe upper assembly and proceeding on the insole near its periphery, at each side thereof, to the ball region thereof. Conceptually the ribbon of adhesive could be placed onto the outwardly extending margin or at the confluence of the outwardly extending margin and the insole Irrespective of that issue, it is a principal object of the present invention to provide mostly a mechanically-based system—as distinguished from the essentially electrically-based and microprocessor-controlled systems now being proposed—to guide adhesive nozzles which deposit adhesive in the lasting of the toe and ball region of a shoe upper assembly.

Another object is to provide a system that uses cams and a guide template to direct the adhesive nozzles along acceptable paths between the toe and ball (or other) region of the shoe upper assembly at or near the periphery of the insole.

Still another object is to provide a machine that can be serviced in countries not technologically advanced, often using local facilities.

A still further object is to provide a machine that is significantly non- environmentally affected.

These and still further objects are addressed hereinafter.

The foregoing objects are attained, generally, in apparatus to apply adhesive to the toe and ball (or other) region of the insole of a footwear upper assembly that includes a last, an upper draped about the last and an insole at the last bottom, which apparatus includes a pair of adhesive nozzles to apply the adhesive onto the outer surface of the insole along a path near the edge at outside of the insole (or to another part of the upper assembly near the edge at outside of the insole); a pair of nozzle arms, each nozzle arm of the pair being connected to one of the pair of adhesive nozzles and adapted to move the associated nozzle secured thereto; a mechanical structure operable properly to guide the nozzles along respective paths adjacent the edge at each side of the insole to deposit a ribbon of adhesive onto the outer surface of the insole from the toe (or other) region of the upper assembly to the ball (or other) region of the upper assembly, the mechanical structure including four nozzle-guide segments that together and in combination are configured to form a nozzle-guide template having an outline that, together with other mechanical structures, matches the outline of the edge of the insole between the toe (or other region) and ball (or other) region of the smallest upper assembly of the style to be lasted, the nozzle-guide template having a guide surface and being shiftable to accommodate right footwear upper assemblies and left footwear upper assemblies of the style to be lasted, two of the nozzle-guide segments being pivotally connected to permit angular adjustment at the toe region thereof of one toe segment relative to the other to match the outline of the insole for footwear sizes larger than the smallest footwear upper assembly as well as for different insole shapes; a template follower connected to each nozzle arm, one template follower being positioned to ride along the guide surface at each side of the nozzle-guide template; and a drive mechanism operable to move the template follower from the toe (or other) region of the nozzle-guide template to the ball (or other) region thereof. The two segments at the toe region are pivotally connected to permit angular adjustment at the toe region and each is pivotally connected to one of the other segments at its ball end (or in such a way as) to provide a segmented template whose shape can be changed to accommodate various types of footwear.

The invention is hereinafter described with reference to the accompanying drawing in which.

Figure 1:
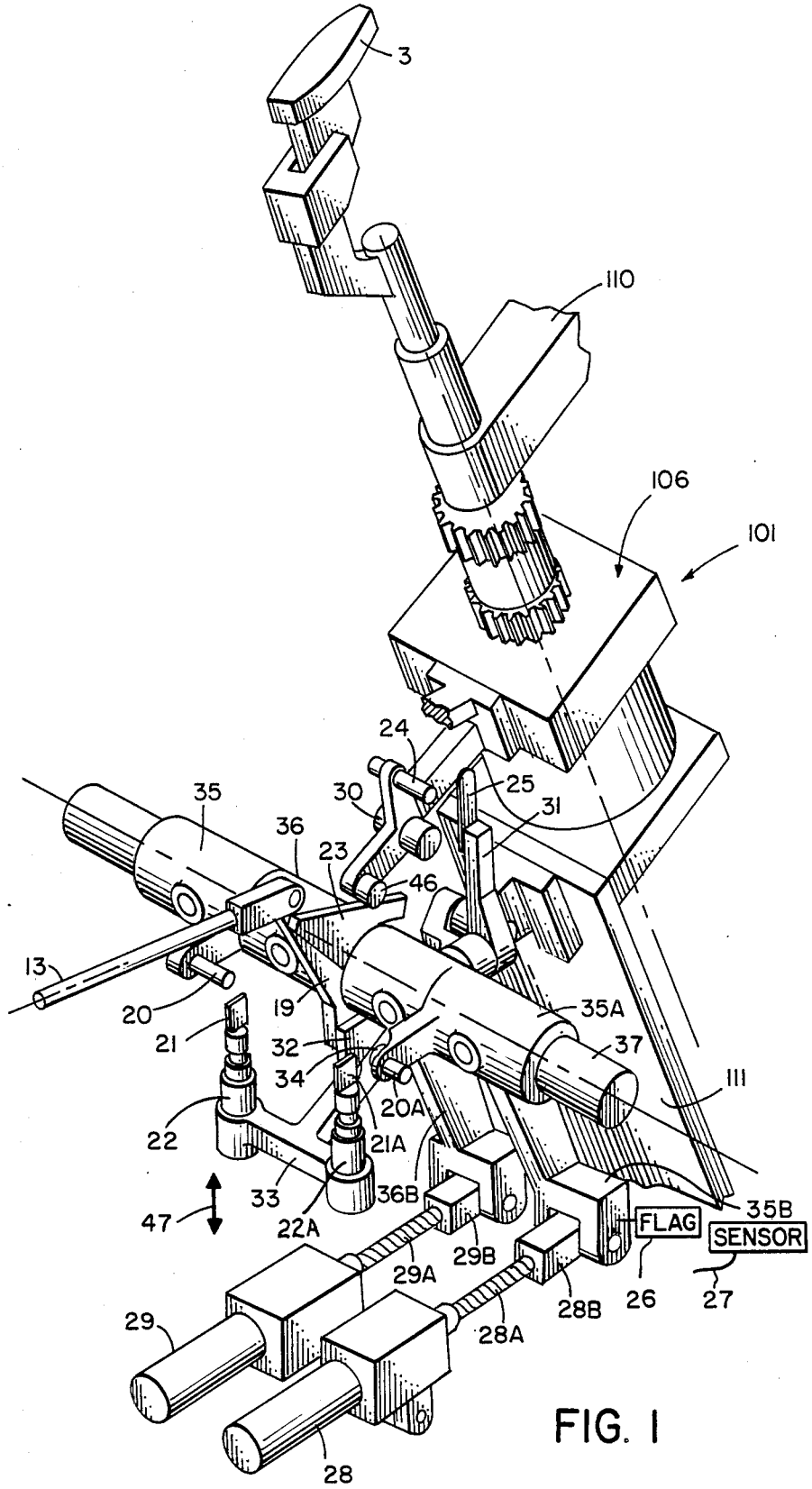
FIG. 1 is an isometric view showing portions of a machine that includes apparatus to apply an adhesive (cement) to the toe and ball region of a shoe (or other footwear) upper assembly.
Figure 2A:
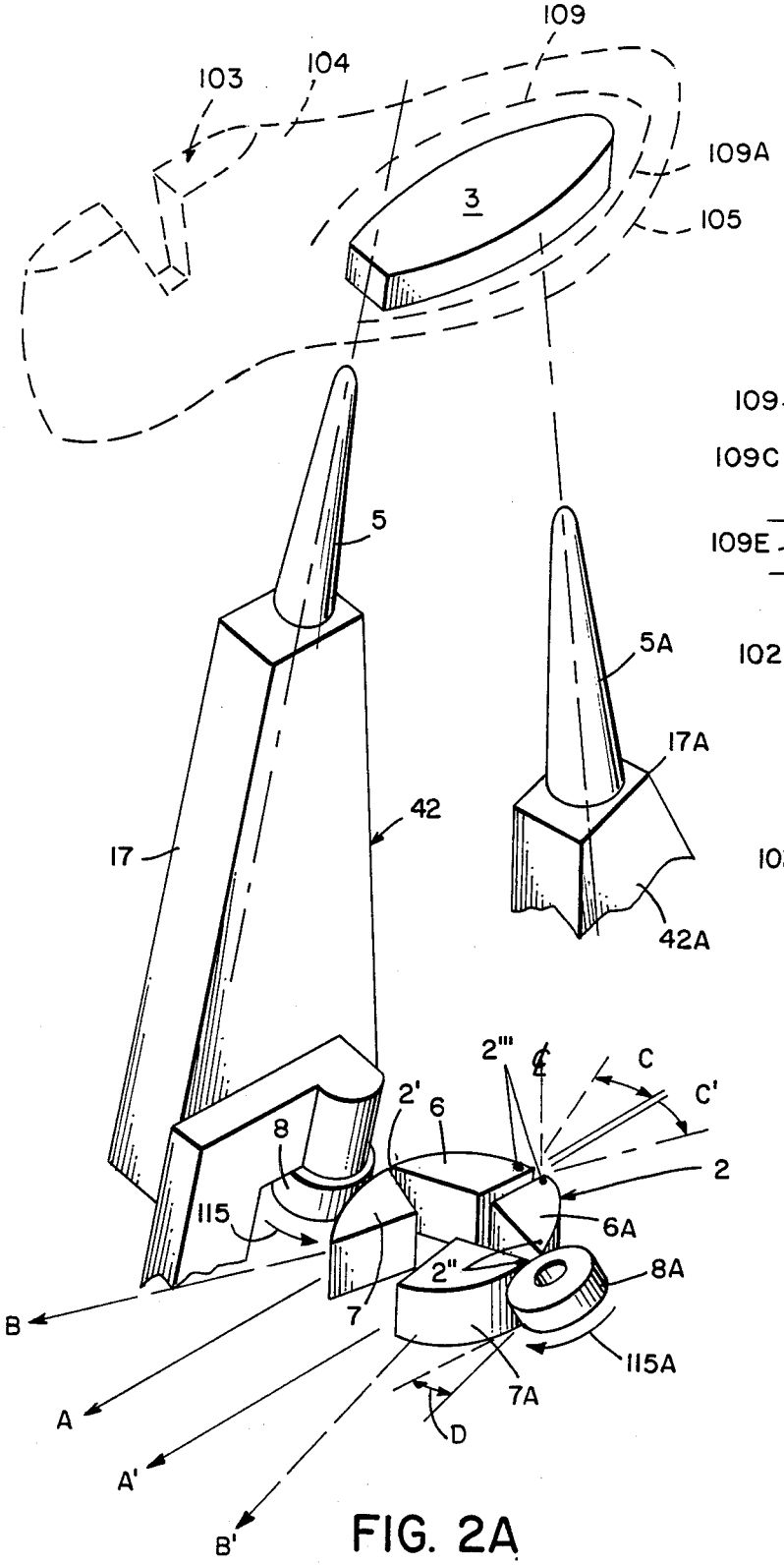
FIG. 2A is an isometric view of a portion of the machine in FIG. 1 showing a mechanical system to guide adhesive-applying nozzles in the machine of FIG. 1.
Figure 2B:
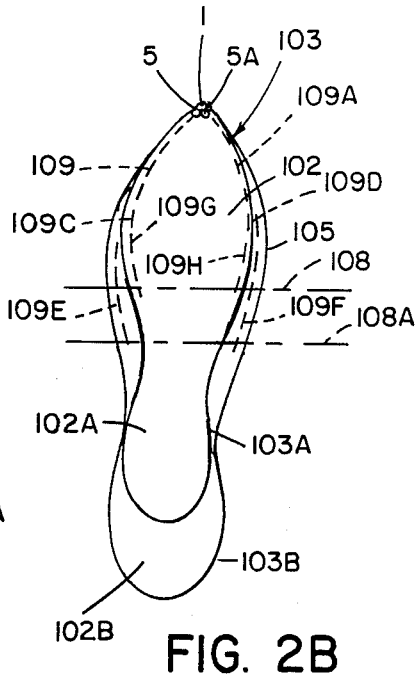
FIG. 2B is a plan view bottom up of two shoe upper assemblies to show the outline of the shoe upper assemblies of differing shoe size.

Turning now to FIG. 1, there is shown at 101 portions of a machine to apply adhesive or cement to the toe and ball region of the insole labeled 102 in FIG. 2B of a shoe (or other footwear) upper assembly 103 that includes a last 104 in FIG. 2A, an upper 105 draped about the last and the insole 102 disposed at the bottom of the last 104. (It will be appreciated on the basis of this disclosure that the present invention can be applied to depositing adhesives to other parts of the footwear upper assembly, but toe and ball lasting are discussed mostly herein ) According to the present teaching, and it is a most important aspect of the present invention, a mechanical structure is provided to guide the nozzles labeled 5 and 5A in FIG. 2B between the toe region marked 11 (where the nozzles 5 and 5A are positioned in FIG. 2B) and the ball region of the upper assembly 103 to apply an adhesive as a ribbon—preferably onto the outer surface of the insole 102 near the periphery thereof on both sides of the insole—from the toe region of the shoe upper assembly 103 to and including the ball region thereof.

Figure 3:
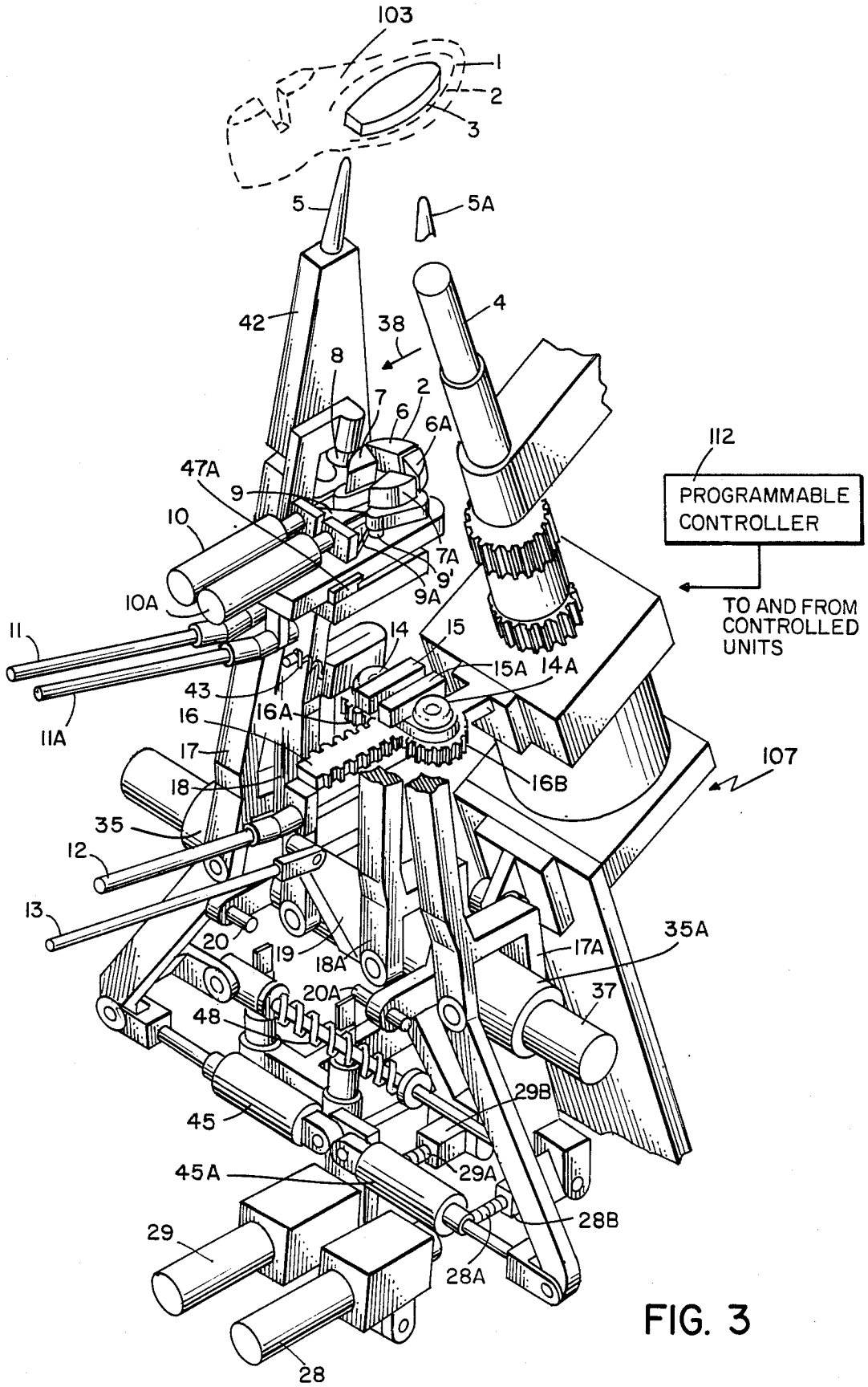
FIG. 3 is an isometric view, like the view in FIG. 2A and partly sectioned, but showing further related machine parts.

The actual apparatus that applies the ribbon of adhesive onto the insole 102 is generally shown at 107 in FIG. 3 which includes most of the interacting structures used to perform the various functions in accordance with the present teaching. The function of the apparatus 107 is to apply an adhesive ribbon 109 and an adhesive ribbon 109A in FIG. 2B from the nozzles 5 and 5A, respectively, in FIG. 2A onto the insole 102 of the upper assemblies 103A and 103B in FIG. 2B In FIG. 2B there are two upper assemblies 103, 103A and 103B, the former representing the smallest assembly of one shoe type and the latter representing he largest of the same shoe the upper assembles 103A and 103B include insoles 102A and 102B, respectively. The nozzles 5 and 5A are guided according to the present teaching by a mechanical guidance system that directs them along respective paths to apply the ribbon of adhesive at 109C and 109D (i.e., on the left side of the insole 102 and the right side of the insole 102, respectively, in FIG. 2B) at the toe region 1 of either assembly 103A or 103B; but toward the heel region the adhesive ribbon follows different paths (i.e., the paths labeled 109G and 109H for the smaller size upper assembly 103A and the paths 109E and 109F for the larger size upper assembly 103B) It is to provide a mostly mechanical guidance system for the nozzles 5 and 5A to deposit the ribbons 109 and 109A for the sizes 103A and 103B, and all sizes in between, that the present invention is directed. The end of the ribbon for the smallest size is approximately at 108 in FIG. 2B and for the largest size is approximately at 108A.

It will be appreciated that the mechanism 107 is part of a machine, for example, like that in the Vornberger patent, the adhesive extruding portions of the Vornberger patent being replaced by the nozzles 5 and 5A herein and related apparatus. Thus the insole rest designated 3 in FIG. 2A is similar to the insole rest shown in the Vornberger patent. The structure marked 106 in FIG. 1 is similar to or identical to structures in the Vornberger patent, and the structural members shown at 110 and 111 in FIG. 1 are attaching structures to a machine, for example, like that shown in the Vornberger patent. It is assumed that no further detailed explanation of the structure 106 is needed here. The remainder of this specification is directed mostly to the mechanism 107 which is a mostly mechanical structure whose function it is to direct the path of the adhesive nozzles 5 and 5A at or near the edges of the insole 102 (that is, in the region of the edge at each side of the insole 102 between the toe part thereof and the ball part thereof), whereby ribbons of molten adhesive are applied onto the insole 102, the margins of the upper 105 being thereafter wiped onto the insole in a known manner. (Conceptually, the adhesive can be applied onto the margin of the upper assembly, but preferably it is applied onto the outer surface of the insole 102, near the edge or periphery of the insole.)

The apparatus 107 in FIG. 3 includes the pair of adhesive nozzles 5 and 5A to apply adhesive onto the footwear upper assembly 103—preferably onto the outer surface of the insole—near the edge (or periphery) of the insole 102 in FIG. 2B. A pair of nozzle arms 17 and 17A support and carry adhesive-extruding assemblies 42 and 42A; one nozzle arm of the pair of nozzle arms 17 and 17A is secured to each nozzle of the pair of nozzles 5 and 5A and is adapted to move the nozzle secured thereto. The arm 17 is secured to and moves the nozzle 5 and the arm 17A is secured to and moves the nozzle 5A. The mechanical structure 107 is operable to properly guide the nozzles 5 and 5A along the respective paths 109 and 109A adjacent each edge of the insole 102 to deposit a ribbon of adhesive onto the upper assembly 103 from the toe of the upper assembly to the ball region of the upper assembly. A brief discussion of FIG. 4 is made at this juncture.

Figure 4:
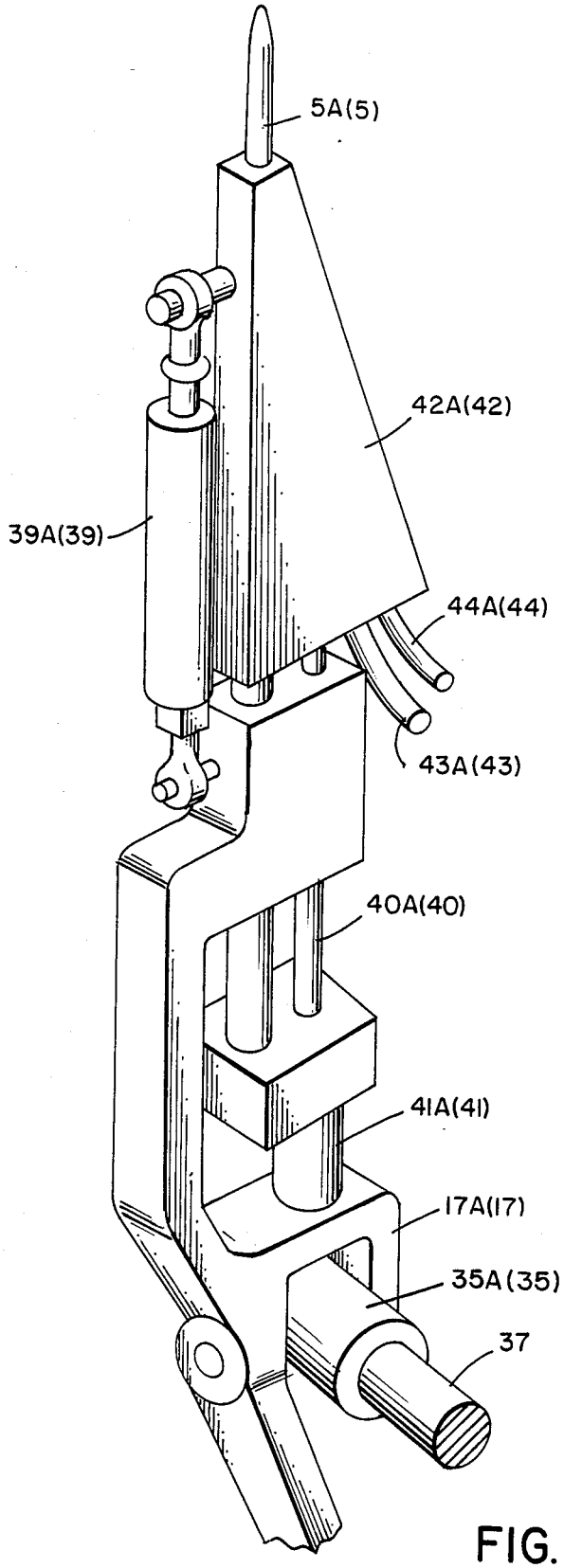
FIG. 4 is an isometric view of the machine showing some parts not shown in other figures.

The structures shown in FIG. 4 are the right arm 17A with the further parts of the assembly 42A associated therewith. In FIG. 4 the corresponding parts associated with the arm 17 are shown in parentheses, e.g., the air cylinder 39, the nozzles and so forth. In FIG. 4 the label 40A (40) is for a shut-off needle valve; the label 43A (43) is for a feed tube of adhesive; the label 44A (44) is for an electrical conduit to a heater in the assembly 42A (42); the label 41A (41) is for an air cylinder to activate the needle valve 40A (40); and the label 37 is for a pivot shaft, later discussed. The needle valve 40A (40) is moved up and down in FIG. 4 respectively to stop adhesive flow from the nozzle 5A (5) and to start flow therefrom.

In the shoemaking process, one approach is that of lasting the toe region of the shoe upper assembly first; then the ball and heel region are lasted. Typically the adhesive is applied onto the insole, which is disposed bottom down in a machine like that shown in the Vornberger patent, and the margin of the upper assembly is then wiped onto the insole. That is done according to the present teaching except that both the toe region and the ball region of the insole have adhesive applied thereto by two single-output nozzles and are wiped. The point made here is that, conceptually, the adhesive could be applied to the margin of the upper assembly, rather than the insole, and the wiping could be effected, but application of adhesive as a ribbon on the insole is preferred, and either location comes within the characterization that adhesive is applied in the region of the periphery of the insole.

The single-output nozzles 5 and 5A begin the adhesive applying cycle at 1 in FIG. 3, which is the position of the nozzles 5 and 5A shown in FIG. 2B, the nozzles 5 and 5A first having been raised vertically by the cylinders 39 and 39A, respectively, in FIG. 4. A stepper motor 28 in FIG. 1 positions the nozzles 5 and 5A to track along the cement paths 109 and 109A in FIGS. 2A and 2B to deposit the adhesive as a continuous ribbon at 109 and 109A. The arms 1 and 17A, and hence the nozzles 5 and 5A, are allowed to move in a universal manner by pivoting on parts 35 and 35A, respectively, in FIG. 1, that also pivot on a shaft 37. The arms 17 and 17A are respectively attached to cam rolls (or rollers) 8 and 8A in FIG. 2H which are held against a contour template 2, formed of four segments 6, 7 and 6A, 7A, by a spring 48 in FIG. 3. It will be noted that the segments 6, 7, 6A and 7A each represents essentially one ninety degree quadrant of the template 2 which, when the segments are together, is, or can be, almost circular in plan view. However, the toe-end segments 6 and 6A are individually pivotal at 2'''at the toe region thereof; the segments 6 and 7 are pivotal at 2'; and the segments 6A and 7A are pivotal at 2''. To summarize, for any shoe style, two sets of template segments 6-7 and 6A-7A (four segments, two segment units or sets) is established. For any shoe size or a style, each segment set 6-7 and 6A-7A pivots at the region 2''' to some angle determined by the shoe size of the particular style. Further, as is noted below, the segments 6 and 7, as a unit, and the segments 6A and 7A, as a unit, can move in the direction of the arrows A and B and A' and B', respectively, to accommodate various shoe sizes and shapes. A signal from the programmable controller 112, in FIG. 3 causes the motor 29 to start motion of the segments 6 and 7 in the directions of the arrows A to B in FIG. 2A and the segments 6A and 7A in the directions of the arrows A' to B'.

With reference now to FIGS. 2A and 2B, the function of the contoured template or nozzle-guide assembly 2 is to guide the followers 8 and 8A along appropriate paths so that the nozzles 5 and 5A will apply appropriate ribbons of adhesive 109 and 109A, as now explained. The template segments 6, 7, 6A and 7A are replaceable to accommodate various shoe styles. The shape of any particular template 2, and hence the segments 6, 7, 6A and 7A, is determined by the smallest size of the shoe style For that smallest size, the template segments 6, 7, 6A and 7A may all be touching one another, that is, closed together in FIG. 2A; but typically they will be pivotally separated from one another, as shown in FIG. 2A, to accommodate for left or right shoes and exact sizes Thus, the template segments introduce flexibility.

In operation the follower 8 in FIG. 2A initially moves or rolls counterclockwise (see arrow 115) along the outer surface of the template segment 6 and the follower 8A moves or rolls clockwise (see arrow 115A) along the outer surface of the template segment 6A; at an intermediate point the follower 8 rolls onto and along the outer surface of the template segment 7 and the follower 8A rolls onto and along the outer surface of the template segment 7A. At that juncture, typically, the followers will have completed the necessary travel on the smallest shoe size and to have applied adhesive ribbons 109 and 109A to the line 108 in FIG. 2B, that is, from the toe region to the ball region of the smallest shoe size of a given type. When apply adhesive ribbons onto the insole 102 of shoe sizes larger than the smallest shoe size of a type, the template segments 6-7 and 6A-7A are caused to move in the direction of the arrows A or B or A' or B', respectively, or any direction in between, as noted elsewhere herein. The template segments 6 and 7 move as a unit in the direction of the arrows A or B or any direction in between; the template segments 6A and 7A simultaneously move as a unit in the direction of the arrows A' or B' or any direction in between. Simultaneously, the followers 8 and 8A, in FIG. 2A, are being moved along the outer perimeter surface of the corresponding segments or segment units 6-7 and 6A-7A to move the nozzles 5 and 5A, respectively, along the correct paths for adhesive deposit which ends at the appropriate line 108 or 108A or any line in between. The labels 2' and 2'', as above indicated, represent pivots (or regions of pivot) between template segments 6 and 7 and 6A and 7A about which the associated template segments pivot to accommodate right shoe assemblies and left shoe assemblies; the degree of pivot may also be related to shoe sizes or types. There is also the pivot region at 2''', as above noted, to an angle C for the segments A and 7A and C' for the segments 6 and 7 to provide an adjustment because of size. It will be appreciated in this explanation that it is the size or style of the insole being processed or lasted that determines all movement of the nozzles 5 and 5A and hence the nozzle-guide assembly 2.

The mechanisms to move the segments 6, 6A, 7 and 7A and the followers 8 and 8A are now discussed, mostly with reference to FIGS. 1 and 3, beginning with the followers. The followers 8 and 8A are attached to the arms 17 and 17A, respectively, which are driven by the stepper motor 28 which is turned on and off by the programmable controller 112 which also controls the start of the adhesive extrusion and start of nozzle travel and control from beginning to end When the motor 28 is energized, it rotates the ballscrew marked 28A and hence moves a ball nut 28B to right and left in FIG. 1; it pivots an arm 35B counterclockwise about a shaft 37 to which are keyed sleeves 35 and 35A. The cement arms 17 and 17A are pinned to the sleeves 35 and 35A and hence pivot together with the sleeves; the pinning also permits the arms 17 and 17A to pivot about an axis orthogonal to the axis of the shaft 37 by forces originating with the followers 8 and 8A as the followers move along the template. The adhesive extrusion is stopped by signals from sensors 20 and 20A in combination with flags 21 and 21A; the same signals also start the nozzles 5 and 5A down. It will be understood that the connecting structure for the arms 17 and 17A is a universal joint about which the arms pivot in a motion whose configuration is determined by the template 2.

Movement of the template segments 6-7 and 6A-7A along the directions A . . . is similar to that discussed above with respect to the followers 8 and 8A in that stepper motor 29 rotates a ball screw 29A and hence moves a ball nut 29B to the right and left in FIG. 1, pivoting an arm 36B, again about the shaft 37 through a sleeve 36 to which are attached arms 18 and 18A in FIG. 3. The arms 18 and 18A are also universally attached to pivot about the shaft 37. The segments are attached to the arms 18 and 18A and it is the arms 18 and 18A that provide movement along the directions A or B or A' or B', the exact direction of movement being determined in a manner now explained.

A follower 14 in FIG. 3 is attached to the arm 18 and a like follower 14A is attached to the arm 18A. The follower 14 follows along a guide bar 15 while, simultaneously, the follows 14A follows along a guide bar 15A. The guide bars 15 and 15A are adjustable either parallel to one another to provide motion A-A' or at an angle to one other to provide motion B-B' (or any angle therebetween). A rack 16 and pinions 16A and 16B ,effect angular adjustment of the guide bars 15 and 15A, adjustment being through a rotary adjustment shaft 12.

Air cylinders 10 and 10A shift segments 7 and 7A about 2' and 2'', respectively, to accommodate left shoes or right shoes, as above note, by movement of guide elements 9 and 9A under the action of the air cylinders causing movement of elements 9' (only one shown) connected respectively to segments 7 and 7A as in FIG. 3. Rotation of rods 11 and 11A effect pivoting at 2''' to the angles C-C' in FIG. 2A. A spring 43 causes the cam rolls 14 and 14A to remain in contact with the guide bars 15 and 15A A spring 48 causes arms 17 and 17A and, hence, cam rolls 8 and 8A to keep in contact with the segments 6, 6A, 7 and 7A. For square toe applications cylinders 45 and 45A provide transverse forces on the followers 8 and 8A to cause the followers to move along the template.

Pivoting at 2''' is effected by two circular guide plates, e.g., a guide plate 47A which pivots the segments 6A and 7A as a unit 6A-7A at 2''' counterclockwise and clockwise in FIG. 3. A like plate pivots the segments 6 and 7 as a unit 6-7 at 2''' clockwise and counterclockwise. It will be appreciated that 2''' is a region of pivot—not a pivot point. The segmented units 6-7 and 6A-7A are not connected to one another at the pivot region 2''' and can move away from one another during the linear or translational movement mentioned elsewehere herein.

It has been found for present purposes and on the basis of the teachings herein that a segmented template 2 for any shoe style can be formed by a combination of graphical and triangulation methods known in the mechanical arts. Briefly, the rotational axes of the rollers 8 and 8A are located in the machine with respect to the adhesive paths 109 and 109A and relative positions between these machine parts and locations determine the external contour of the segmented template 2 and hence the path of travel of the rollers 8 and 8A along the external contour of the template 2. Variations in the paths 109 and 109A of the adhesive ribbon can be accommodated by positional changes of the segments 6, 6A, 7 and 7A of the template 2 about the pivots 2', 2''and 2''', plus changes in the angles A to B and A' to B' and changes in segment size.

Turning now to FIG. 1, a rod 13 connects to a heel-lock assembly (not shown) whereby the shoe size is established. If the rod 13 is all the way to the right in FIG. 1, a small shoe is indicated. The rod 13 is attached to a sensor-cam mounting plate 19 that is journalled to the shaft 37; the plate 19 supports sensor cams 23 and 32 on which ride a roller 46 and a roller 34, respectively. A sensor 24 pivots about a shaft 30 under control of the roller 46 to establish the stop point for the motion of the templates along the paths whose directions are A or B or A' or B' or any angle therebetween; start of that motion is determined by a sensor 27 in FIG. 1 in cooperation with a sensor flag 26 which moves left and right with rotation of the rod 28A to which it is attached. The sensor 24 similarly cooperates with a flag 25 which is attached to the arm 31 which is attached to the sleeve 36 which, as above-noted, is moved by the motor 29.

The motor 28 at all times gives maximum travel to the arms 17 and 17A; that is, for the largest shoe size, but the air cylinder 39 or 39A in FIG. 4 pulls the associated nozzle downward and away from the inner sole at the appropriate stop point 108 or 108A (or any point in between) and simultaneously moves the needle 40A (40) upward to terminate adhesive flow from the nozzle 5A (5). The signal for such purpose comes from the sensors 20 and 20A in cooperation with flags 21 and 21A which are positioned by the sensor cam 32. A cam roll 34 is attached to an arm 33 which holds the flags 21 and 21A which are shiftable up or down (see arrow 47) by air cylinders 22 and 22A to provide proper shut-off and pull-down at a left or right ball break, much the same as the segments were shifted for right and left shoes. This is needed because the length of adhesive 109 differs from the length of adhesive 109A; hence adhesive termination and pull-down differs from one side to the other. While, as noted above, emphasis in this specification is on application of adhesive at each side of a footwear upper assembly between the toe region and ball region thereof, it will be seen on the basis of the foregoing teachings that the adhesive can be applied to other parts of the footwear upper assembly.

Modifications of the invention herein disclosed will occur to persons skilled in the art and all such modifications are deemed to be within the scope of the invention as defined by the appended claims.

What is claimed is:

1. Apparatus to apply adhesive to the toe and ball region of a footwear upper assembly that includes a last, an upper draped about the last and an insole at the last bottom, which apparatus comprises:

a pair of adhesive nozzles to apply the adhesive onto the footwear upper assembly near the edge of the insole;

a pair of nozzle arms, one nozzle arm of the pair of nozzle arms being secured to each nozzle of the pair of adhesive nozzles and adapted to move the nozzle secured thereto;

a mechanical structure operable to guide the nozzles along respective paths adjacent each edge of the insole to deposit a ribbon of adhesive onto the upper assembly from the toe of the upper assembly to the ball region of the upper assembly, said mechanical structure comprising a nozzle-guide template that is configured to an outline that, together with other mechanical structures, matches the outline of the insole between the toe and the ball region of the smallest upper assembly of the style to be lasted, the nozzle-guide template having a guide surface and being shiftable to accommodate right footwear upper assemblies and left footwear upper assemblies of the style to be lasted, said nozzle-guide template comprising a pair of nozzle-guide segments individually pivotally connected at the toe region thereof to permit angular adjustment of one segment of the pair of segment relative to the other to match the shape of the insole for footwear sizes larger than the smallest footwear upper assembly;

a template follower connected to each nozzle arm, one follower being positioned to ride along the guide surface of each nozzle-guide template; and drive means operable to move the template follower from the toe region of its associated nozzle-guide template to the ball region thereof.

2. A lasting machine according to claim 1 in which each of the pair of nozzle-guide segments is adapted to move along a path having a longitudinal component, said lasting machine having a template drive mechanism connected to move the segments along said path.

3. A lasting machine according to claim 2 in which the template drive mechanism is operable to move the segments along a path having said longitudinal component, but having as well, a transverse component whereby the templates pivot about the toe region of the pair of nozzle-guide templates to provide said transverse component.

4. A lasting machine according to claim 3 in which the template drive mechanism includes a template arm connected to each segment of the pair of nozzle-guide segments, a template follower connected to each template arm and an angularly adjustable arm and a guide bar associated with each template follower such that the associated template follower moves along and is guided by the guide bar associated therewith.

5. A lasting machine according to claim 1 in which the adhesive nozzles apply the adhesive ribbon at each side of the insole onto the outer surface of the insole near the edge thereof.

6. A lasting machine according to claim 1 in which said template follower is spring loaded to maintain rolling contact with the template but in which air cylinders are provided to provide transverse forces on each follower to counteract spring pressures for square-toe footwear upper assemblies.

7. Apparatus to apply adhesive to a footwear upper assembly that includes a last, an upper draped about the last and an insole at the last bottom, which apparatus comprises:

adhesive nozzle means to apply the adhesive onto the footwear upper assembly near the edge of the insole;

nozzle arms means secured to the adhesive nozzle means and adapted to move the adhesive nozzle means secured thereto;

a structure operable to guide the nozzles along respective paths adjacent each edge of the insole to deposit a ribbon of adhesive onto the upper assembly, said structure comprising a nozzle-guide template that is configured to an outline that, together with other mechanical structures, matches the outline of the insole of the portion to be lasted of the smallest upper assembly of the style to be lasted, the nozzle-guide template having a guide surface and being shiftable to accommodate different shaped upper, assemblies, said nozzle-guide template comprising segments individually pivotally connected at the toe region thereof to permit angular adjustment of each segment relative to the other to match the shape of the insole for footwear sizes larger than the smallest footwear upper assembly;

a template follower connected to each nozzle arm, one follower being positioned to ride along the guide surface of each nozzle-guide segment; and drive means operable to move the template follower along said guide surface.

8. A lasting machine to apply adhesive to a footwear upper assembly that includes a last, an upper draped about the last and an insole at the last bottom, which machine comprises:

adhesive nozzle means comprising two nozzles to apply the adhesive onto the footwear upper assembly near the edge of the insole;

nozzle arm means secured to the adhesive nozzle means and adapted to move the adhesive nozzle means secured thereto, the nozzle arm means including two nozzle arms, one nozzle arm connected to each of the two nozzles;

a guide structure mechanically connected to the nozzle arm means, which is operable to guide the nozzle arm means and, hence, the two nozzles along paths adjacent the edge of the insole to deposit a ribbon of adhesive onto the upper assembly, said guide structure comprising a nozzle-guide template that is configured to an outline that, together with other mechanical structures that interact therewith, matches the outline of a portion of the insole to be lasted, the nozzle-guide template having a guide surface and being shiftable to accommodate different shaped upper assemblies, said nozzle-guide template comprising a pair of nozzle-guide segments having a toe region and being pivotally connected at the toe region thereof to permit angular adjustment of each segment relative to the other to match, in conjunction with the other mechanical structures that interact therewith, the shape of the insole of the footwear upper assembly;

a pair of template followers associated with the nozzle arm means, one template follower being connected to each nozzle arm, one template follower being positioned to ride along the guide surface of each nozzle-guide segment; and drive means operable to move the template followers along said guide surface.

9. A lasting machine according to claim 8 in which each of the pair of nozzle-guide segments is adapted to move along a path having a longitudinal component, said lasting machine having a template drive mechanism connected to move the segments along said path.

10. A lasting machine according to claim 9 in which the template drive mechanism is operable to move the segments along a path having said longitudinal component, but having a transverse component as well.

11. A lasting machine according to claim 10 in which the template drive mechanism includes a template arm connected to each segment of the pair of nozzle-guide segments, a template arm follower connected to each template arm, and an angularly adjustable arm and a guide bar associated with each template follower arm such that the associated template follower moves along and is guided by the guide bar associated therewith.

12. A lasting machine according to claim 8 in which the adhesive nozzles apply the adhesive ribbon at each side of the insole onto the outer surface of the insole near the edge thereof.

13. A lasting machine according to claim 8 in which the guide structure comprises two segment pairs, each pair acting as a unit, each segment of a unit being pivotal with respect to the other segment of the unit, each said unit being adapted to move along a path having a longitudinal component and a transverse component, said lasting machine having a template drive mechanism connected to drive each unit along its respective path.

14. For use in a system that includes adhesive nozzle means to apply an adhesive onto a footwear upper assembly near the edge of the insole thereof, said footwear upper assembly including a last, an upper draped about the last and said insole at the last bottom, a structure operable to guide the nozzle means along a path adjacent each edge of the insole to deposit an adhesive onto the upper assembly, said structure comprising a nozzle-guide template having a guide surface that is configured to an outline that, together with other mechanical structures that interact therewith, matches the outline of the insole of the portion to be lasted of the upper assembly of the style to be lasted, the nozzle-guide template being shiftable to accommodate at least one of different shaped and sized upper assemblies, said nozzle-guide template comprising segments having a toe region and being individually pivotally connected at the toe region thereof to permit angular adjustment of each segment relative to the other to match at least one of each shape and size of the insole of the footwear upper assembly;

a template follower connected to ride along the guide surface of each nozzle-guide segment and adapted to guide the nozzle means; and drive means operable to move the template follower along said guide surface.

15. In the system of claim 14, apparatus in which each of the segments is adapted to move along a path having a longitudinal component and a transverse component and which includes a template drive mechanism connected to move each segment along its respective path, said adhesive being applied from the toe region of the footwear upper assembly to and including the ball region thereof.

16. In the system of claim 14, apparatus wherein said template comprises four segments which are connected to act as two-segment pairs, a first-segment pair and a second-segment pair, wherein each segment pair is adapted to move along a distinct path and which includes a template drive mechanism connected to move each said segment pair along its respective path while the template follower associated with each segment pair is moved along the guide surface of its associated segment pair.

17. A lasting machine according to claim 16 in which each pair of nozzle-guide segments is adapted to move along a path having a longitudinal component, said lasting machine having a template drive mechanism connected to move each said segment pair along its respective path.

18. A lasting machine according to claim 17 in which the template drive mechanism is operable to move each segment-pair along a path having said longitudinal component, but having as well, a transverse component, wherein each segment pair is pivotal at about the toe region thereof to provide said transverse component.

19. A lasting machine according to claim 18 in which the template drive mechanism includes a template arm connected to each segment pair of nozzle-guide segments, a template follower connected to each template arm and an angularly adjustable arm and a guide bar associated with each template follower such that the associated template follower moves along and is guided by the guide bar associated therewith.

* * * * *